US007583244B2

(12) United States Patent
Werner et al.

(10) Patent No.: US 7,583,244 B2
(45) Date of Patent: Sep. 1, 2009

(54) SIGNAL APPARATUS, LIGHT EMITTING DIODE (LED) DRIVE CIRCUIT, LED DISPLAY CIRCUIT, AND DISPLAY SYSTEM INCLUDING THE SAME

(75) Inventors: James C. Werner, Oakmont, PA (US); Lawrence A. Weber, Allison Park, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 658 days.

(21) Appl. No.: 11/382,734

(22) Filed: May 11, 2006

(65) Prior Publication Data

US 2007/0262920 A1 Nov. 15, 2007

(51) Int. Cl.
*G09G 3/32* (2006.01)

(52) U.S. Cl. ..... 345/82; 345/204

(58) Field of Classification Search ..... 345/82–100, 345/204

See application file for complete search history.

(56) References Cited

U.S. PATENT DOCUMENTS

| | | | | |
|---|---|---|---|---|
| 3,755,697 | A | 8/1973 | Miller | |
| 4,250,501 | A | 2/1981 | Pokrandt | |
| 4,571,506 | A | 2/1986 | Lisco | |
| 5,633,651 | A * | 5/1997 | Carvajal et al. | 345/82 |
| 5,742,133 | A | 4/1998 | Wilhelm et al. | |
| 6,380,689 | B1 | 4/2002 | Okuda | |
| 6,583,581 | B2 | 6/2003 | Kaneko et al. | |
| 6,894,436 | B2 * | 5/2005 | Togashi et al. | 315/169.4 |
| 6,963,177 | B2 | 11/2005 | Ito et al. | |
| 2002/0089291 | A1 | 7/2002 | Kaneko et al. | |
| 2002/0195968 | A1 | 12/2002 | Sanford et al. | |
| 2003/0179626 | A1 | 9/2003 | Sanford et al. | |
| 2003/0214249 | A1 | 11/2003 | Kaneko et al. | |
| 2004/0012986 | A1 | 1/2004 | Riggio et al. | |
| 2004/0095121 | A1 | 5/2004 | Kernahan et al. | |
| 2005/0007321 | A1 | 1/2005 | Schuler | |
| 2005/0030265 | A1 | 2/2005 | Miyagawa | |
| 2005/0073263 | A1 | 4/2005 | Havlik et al. | |
| 2005/0167691 | A1 | 8/2005 | Kaneko et al. | |

(Continued)

OTHER PUBLICATIONS

Lumileds Lighting, "Luxeon® K2 Emitter", 2006, 25 pp.

*Primary Examiner*—Amare Mengistu
*Assistant Examiner*—Solomon Berhane
(74) *Attorney, Agent, or Firm*—Eckert Seamans Cherin & Mellott, LLC; Kirk Houser, Esq.

(57) ABSTRACT

A light emitting diode (LED) circuit includes first and second terminals, a forward circuit including a number of LEDs electrically connected in series, and a forward steering diode electrically connected in series with the LEDs. The series combination of the forward steering diode and the LEDs is electrically connected between the first and second terminals, and is structured to conduct current in a first direction with respect to the first and second terminals in order to illuminate the LEDs. A reverse circuit includes a resistor, and a reverse steering diode electrically connected in series with the resistor. The series combination of the reverse steering diode and the resistor is electrically connected between the first and second terminals, and is structured to conduct current in an opposite second direction with respect to the first and second terminals such that the LEDs are not illuminated. An LED drive circuit is also disclosed.

26 Claims, 5 Drawing Sheets

U.S. PATENT DOCUMENTS

2006/0015272 A1 1/2006 Giraldo et al.
2006/0022900 A1 2/2006 Miyake et al.
2006/0022918 A1 2/2006 Tang et al.
2007/0262920 A1* 11/2007 Werner et al. ..... 345/46

* cited by examiner

SIGNAL APPARATUS, LIGHT EMITTING DIODE (LED) DRIVE CIRCUIT, LED DISPLAY CIRCUIT, AND DISPLAY SYSTEM INCLUDING THE SAME

BACKGROUND OF THE INVENTION

1. Field of the Invention

This invention pertains generally to signal apparatus and, more particularly, to signal apparatus, such as a light emitting diode (LED) display circuit employing a number of LEDs. The invention also relates to LED drive circuits. The invention further relates to display systems including an LED display circuit and an LED drive circuit.

2. Background Information

A known problem with a "naked" LED, which is employed in a local circuit without any active drive electronics, is that induced noise on the drive signal conductor from a remote drive circuit may run the risk of causing the "naked" LED to light inadvertently, since the "naked" LED may start to light in response to relatively very low power.

The use of hardware check pulses for vitality checking of an LED drive circuit is not compatible with "naked" LEDs, since these LEDs will flash if quickly turned ON-OFF-ON or OFF-ON-OFF. In contrast, hardware check pulses do work with an incandescent light signal because such pulses do not cause an immediate light output when power is applied, but still provide a path for the drive current.

It is known to provide a reverse bias voltage directly to a light emitting element such that it does not cause light emission. See, for example, U.S. Patent Application Publication No. 2006/0022900.

There is room for improvement in signal apparatus, such as light emitting diode (LED) display circuits. There is also room for improvement in LED drive circuits. There is further room for improvement in display systems including an LED display circuit and an LED drive circuit.

SUMMARY OF THE INVENTION

These needs and others are met by embodiments of the invention, which provide a light emitting diode drive circuit and light emitting diode display circuit that allow for a true "naked" LED circuit with protection from light output due to induction on, for example, a drive signal conductor from the light emitting diode drive circuit. Furthermore, in embodiments employing plural drive channels from the light emitting diode drive circuit to corresponding light emitting diode display circuits, the current and voltage readings for a selected one of the plural drive channels may be shifted by a predetermined offset value, in order to verify that the proper current and voltage for the expected channel is being properly read. Also, the output of the light emitting diode drive circuit may be monitored to determine whether it is properly or improperly driven with the desired current and voltage under various different conditions.

In accordance with one aspect of the invention, a signal apparatus comprises: a number of light emitting diode circuits, each of the light emitting diode circuits comprising: a first terminal; a second terminal; a forward circuit comprising: a number of light emitting diodes electrically connected in series, and a forward steering diode electrically connected in series with the light emitting diodes, wherein the series combination of the forward steering diode and the light emitting diodes is electrically connected between the first and second terminals, and wherein the series combination is structured to conduct current in a first direction with respect to the first and second terminals in order to illuminate the light emitting diodes; and a reverse circuit comprising: a resistor, and a reverse steering diode electrically connected in series with the resistor, wherein the series combination of the reverse steering diode and the resistor is electrically connected between the first and second terminals, wherein the series combination of the reverse steering diode and the resistor is structured to conduct current in a second direction with respect to the first and second terminals in order that the light emitting diodes are not illuminated, and wherein the second direction is opposite the first direction.

As another aspect of the invention, a light emitting diode circuit comprises: a first terminal; a second terminal; a forward circuit comprising: a number of light emitting diodes electrically connected in series, and a forward steering diode electrically connected in series with the light emitting diodes, wherein the series combination of the forward steering diode and the light emitting diodes is electrically connected between the first and second terminals, and wherein the series combination is structured to conduct current in a first direction with respect to the first and second terminals in order to illuminate the light emitting diodes; and a reverse circuit comprising: a resistor, and a reverse steering diode electrically connected in series with the resistor, wherein the series combination of the reverse steering diode and the resistor is electrically connected between the first and second terminals, wherein the series combination of the reverse steering diode and the resistor is structured to conduct current in a second direction with respect to the first and second terminals in order that the light emitting diodes are not illuminated, and wherein the second direction is opposite the first direction.

The forward circuit may further comprise a resistor, the resistor being electrically connected in series with the series combination of the forward steering diode and the light emitting diodes. The resistor of the forward circuit may include a resistance. The light emitting diodes may include a common color and a common forward voltage, the common forward voltage being operatively associated with the common color and the current in a first direction which illuminates the light emitting diodes. The resistance of the resistor of the forward circuit may be selected as a function of the common forward voltage and the common color.

As another aspect of the invention, a light emitting diode drive circuit is for driving a number of light emitting diode circuits, each of the light emitting diode circuits including a forward circuit having a number of light emitting diodes electrically connected in series, the light emitting diodes being structured to conduct current in a forward direction and to be responsively illuminated, each of the light emitting diode circuits also including a reverse circuit electrically connected in parallel with the forward circuit, the reverse circuit being structured to conduct current in a reverse direction which is opposite the forward direction. The light emitting diode drive circuit comprises: a processor circuit comprising: a number of first outputs, a number of second outputs, a first analog input, a second analog input, and a processor outputting the first and second outputs and inputting the first and second analog inputs; and for each of the number of light emitting diode circuits: a third input structured to receive a constant current, a third output including a voltage, the third output being structured to drive a corresponding one of the light emitting diode circuits, a first switch responsive to a corresponding one of the first outputs of the processor circuit, the first switch being closed to conduct the constant current in the forward direction to the third output, in order that the conducted constant current in the forward direction to the third output illuminates the light emitting diodes of the corresponding one of the light emitting diode circuits, a circuit structured to sink the current in the reverse direction, a second switch responsive to a corresponding one of the second outputs of the processor circuit, the second switch being closed to conduct the current in the reverse direction from the third output to the circuit structured to sink the current in the reverse direction, in order that the conducted current in the reverse direction from the third output flows in the reverse direction though the reverse circuit of the corresponding one of the light emitting diode circuits, a current sensor structured to sense the constant current in the forward direction to the third output or the current in the reverse direction from the third output and to output a sensed current signal to the first analog input of the processor circuit, and a voltage sensor structured to sense the voltage of the third output and to output a sensed voltage signal to the second analog input of the processor circuit.

As another aspect of the invention, a display system comprises: a constant current regulator including an output and a common terminal; a light emitting diode circuit comprising: a first terminal; a second terminal electrically connected to the common terminal of the constant current regulator; a forward circuit comprising: a number of light emitting diodes electrically connected in series, and a forward steering diode electrically connected in series with the light emitting diodes, wherein the series combination of the forward steering diode and the light emitting diodes is electrically connected between the first and second terminals, and wherein the series combination is structured to conduct current in a first direction with respect to the first and second terminals in order to illuminate the light emitting diodes; and a reverse circuit comprising: a resistor, and a reverse steering diode electrically connected in series with the resistor, wherein the series combination of the reverse steering diode and the resistor is electrically connected between the first and second terminals, wherein the series combination of the reverse steering diode and the resistor is structured to conduct current in a second direction with respect to the first and second terminals in order that the light emitting diodes are not illuminated, and wherein the second direction is opposite the first direction; and a light emitting diode drive circuit comprising: a processor circuit comprising: a first output, a second output, a first analog input, a second analog input, and a processor outputting the first and second outputs and inputting the first and second analog inputs; a third input structured to receive a constant current from the output of the constant current regulator, a third output including a voltage, the third output driving the first terminal of the light emitting diode circuit, a first switch responsive to the first output of the processor circuit, the first switch being closed to conduct the constant current in the forward direction to the third output, in order that the conducted constant current in the forward direction to the third output illuminates the light emitting diodes of the light emitting diode circuit, a sink circuit structured to sink the current in the reverse direction, a second switch responsive to the second output of the processor circuit, the second switch being closed to conduct the current in the reverse direction from the third output to the sink circuit structured to sink the current in the reverse direction, in order that the conducted current in the reverse direction from the third output flows in the reverse direction though the reverse circuit of the light emitting diode circuit, a current sensor structured to sense the constant current in the forward direction to the third output or the current in the reverse direction from the third output and to output a sensed current signal to the first analog input of the processor circuit, and a voltage sensor structured to sense the voltage of the third output and to output a sensed voltage signal to the second analog input of the processor circuit.

The processor may be structured to activate the first output and to deactivate the second output in order to illuminate the light emitting diode circuit; and the processor may include a routine structured to determine whether the light emitting diode circuit is properly or improperly driven by the third output.

The processor may be structured to activate the second output and to deactivate the first output in order to darken the light emitting diode circuit; and the processor may include a routine structured to determine whether the light emitting diode circuit is properly or improperly driven by the third output.

The routine of the processor may further be structured to determine whether an electrical connection between the light emitting diode circuit and the third output is open or shorted, or whether a number of the light emitting diodes are shorted.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" means one or an integer greater than one (i.e., a plurality).

As employed herein, the term "'naked' LED" means a light emitting diode (LED), which is employed in a local circuit without any active drive electronics, such as, for example, a DC-DC converter, a voltage regulator, a current regulator or any other suitable active driver. The "naked" LED is, however, driven, or is capable of being driven, through a conductor by a remote circuit including active drive electronics.

In the railroad industry, for example, "vital" is a term applied to a product or system that performs a function that is critical to safety, while "non-vital" is a term applied to a product or system that performs a function that is not critical to safety. Also, the term "fail-safe" is a design principle in which the objective is to eliminate the hazardous effects of hardware or software faults, usually by ensuring that the product or system reverts to a state known to be safe.

The invention is described in association with displays for an Interlocking Control System (ICS), although the invention is applicable to a wide range of display applications for a wide range of different systems.

Figure 1:
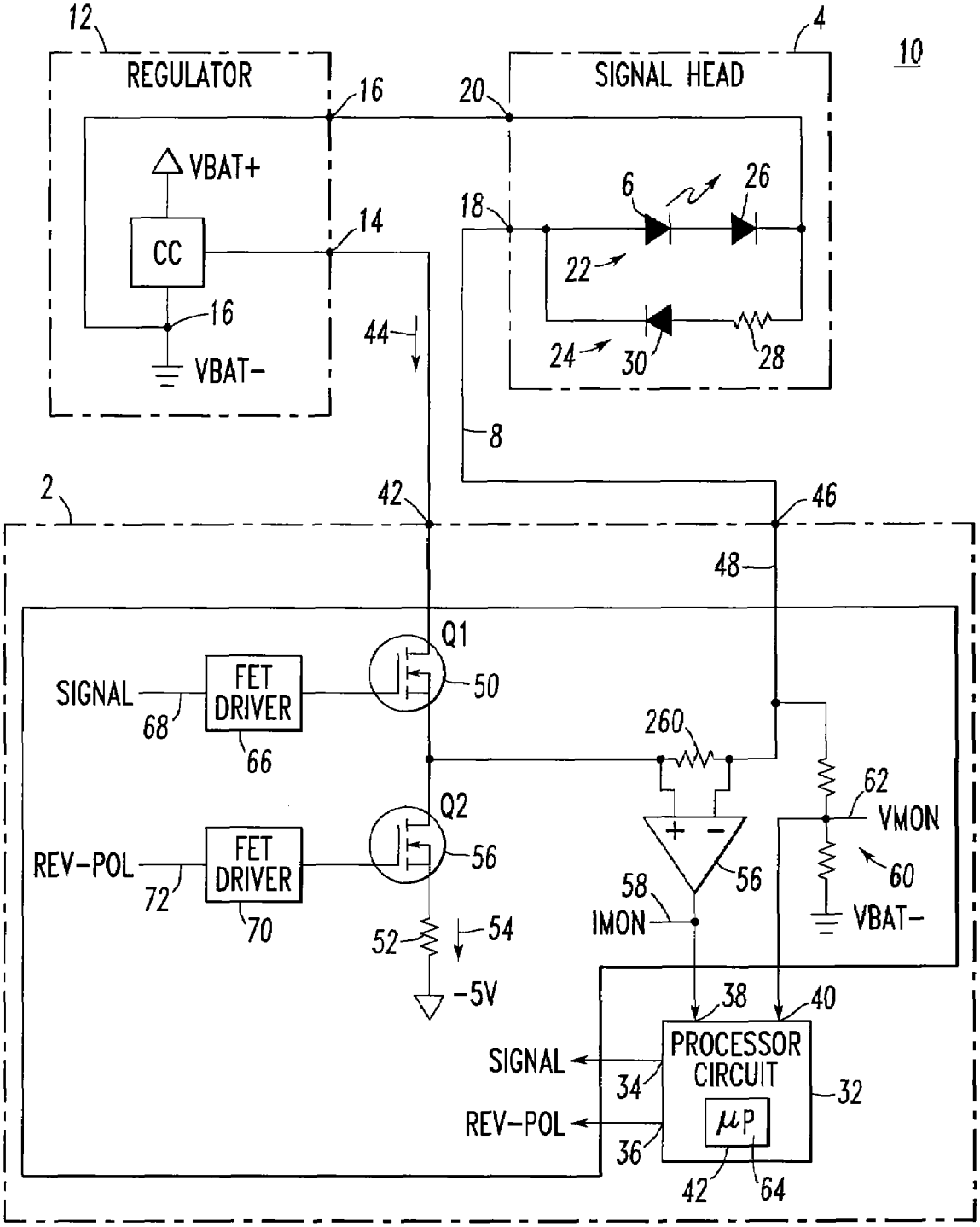
FIG. 1 is a block diagram in schematic form of an LED drive system in accordance with an embodiment of the invention.

Referring to FIG. 1, an LED drive circuit 2 drives a remote LED circuit 4 (e.g., signal module; signal head) including the series combination of a number of "naked" LEDs 6. The LED drive circuit 2 and LED circuit 4 solve the problem of "naked" LEDs by applying a reverse voltage or negative potential on the drive signal conductor 8 to the LED circuit 4. This reverse voltage or negative potential counteracts the induction of noise that may light the "naked" LEDs 6, which are intended to be darkened (e.g., turned off).

Continuing to refer to FIG. 1, a display system 10 includes a constant current regulator 12 (e.g., located at the wayside) having an output 14 and a common terminal 16, the LED circuit 4 (e.g., at the signal head), and the LED drive circuit 2. The LED circuit 4 includes a first terminal 18, a second terminal 20 electrically connected to the common terminal 16 of the constant current regulator 12, a forward circuit 22 and a reverse circuit 24. The forward circuit 22 includes a number (only one LED 6 is shown in FIG. 1) of the LEDs 6 electrically connected in series and a forward steering diode 26 electrically connected in series with the LEDs 6. The series combination of the forward steering diode 26 and the LEDs 6 is electrically connected between the first and second terminals 18,20. This series combination is structured to conduct current in a first direction from the first terminal 18 to the second terminal 20, in order to illuminate the LEDs 6 when a suitable positive voltage with respect to the common terminal 16 is applied to the first terminal 18. The reverse circuit 24 includes a resistor 28 and a reverse steering diode 30 electrically connected in series with the resistor 28. The series combination of the reverse steering diode 30 and the resistor 28 is electrically connected between the first and second terminals 18,20, and is structured to conduct current in an opposite second direction from the second terminal 20 to the first terminal 18, in order that the LEDs 6 are not illuminated.

The LED drive circuit 2 includes a processor circuit 32 having a first output 34, a second output 36, a first analog input 38, a second analog input 40, and a processor 42 (e.g., without limitation, a microprocessor (μP)) outputting the first and second outputs 34,36, and inputting the first and second analog inputs 38,40. The LED drive circuit 2 further includes a third input 42 structured to receive a constant current 44 from the constant current regulator output 14, and a third output 46 including a voltage 48. The third output 46 drives the first terminal 18 of the LED circuit 4. The LED drive circuit 2 also includes a first switch 50 (e.g., FET Q1) responsive to the first output 34 of the processor circuit 32, a sink circuit 52 (e.g., resistor) structured to sink a current 54 in the reverse direction, and a second switch 56 (e.g., FET Q2) responsive to the second output 36 of the processor circuit 32. The first switch 50 is closed to conduct the constant current 44 in the forward direction to the third output 46, in order that this conducted forward constant current illuminates the LEDs 6 of the LED circuit 4. The second switch 56 is closed to conduct the current 54 in the reverse direction from the third output 46 to the sink circuit 52, in order that the conducted reverse current from the third output 46 flows in the reverse direction though the reverse circuit 24 of the LED circuit 4. A current sensor 56 is structured to sense the conducted forward constant current 44 (e.g., without limitation, about 350 mA when the first switch 50 is on and the second switch 56 is off; otherwise, the current is about zero) to the third output 46, or the conducted reverse current (e.g., without limitation, about −50 mA when the first switch 50 is off and the second switch 56 is on; otherwise, the current is about zero) from the third output 46 and to output a sensed current signal 58 (IMON) to the first analog input 38 of the processor circuit 32. A voltage sensor 60 is structured to sense the voltage 48 of the third output 46 and to output a sensed voltage signal 62 (VMON) to the second analog input 40 of the processor circuit 32. The voltage sensor 60 may employ an amplifier (not shown).

The processor 42 is structured to activate the first output 34 and to deactivate the second output 36 in order to illuminate the LED circuit 4. The processor 42 is also structured to activate the second output 36 and to deactivate the first output 34 in order to both darken the LED circuit 4 and apply the reverse voltage. As will be discussed below in connection with Table 1, the processor 42 may advantageously include a routine 64 structured to determine whether the LED circuit 4 is properly or improperly driven by the third output 46 under various different conditions.

The LED drive circuit 2 includes the high side switch 50 for controlling the LEDs 6. When the output drive signal is on, switch Q1 is ON (SIGNAL 68=0), allowing, for example, 350 mA to flow through the series LEDs 6. The ON-state status is checked by the processor 42 reading current and voltage, IMON 58 and VMON 62, respectively.

Example 1

To turn the drive signal to the LED circuit 4 off, switch Q1 is turned OFF by FET driver 66 when SIGNAL 68 is high (=1), and this OFF-state status is verified by the processor 42 checking the IMON signal 58 and the VMON signal 62. In addition, during the OFF-state, a reverse polarity is applied to the third output 46 by turning ON switch Q2 by FET driver 70 when REV-POL 72 is low (=0). This provides a negative voltage to the output drive signal which induces a current through the reverse circuit 24 of the LED circuit 4. In turn, the processor 42 also tests this by checking the IMON signal 58 and the VMON signal 62. This allows for an OFF-state integrity check of the LED circuit 4 and the drive conductor 8 without illuminating the LEDs 6. Also, if left in this state when the drive signal is OFF, the reverse polarity provides additional immunity to an induced current or voltage lighting the LEDs 6, since the noise must overcome the reverse voltage to generate light output.

When the LEDs 6 are not driven, the LED drive circuit 2 applies a negative potential to the drive signal conductor 8 to counteract the possible induction of noise that may light the LEDs 6. Otherwise, induced noise in the drive signal conductor 8 may cause the one or more LEDs 6 to be inadvertently lit.

The first switch Q1 (the ON-OFF switch for the drive signal) is used to apply a positive current to the LED circuit 4 to generate light output. The second switch Q2 is used to apply a negative voltage potential to the LED circuit 4 while it is turned off. The "naked" LED drive signal, as driven by the LED drive circuit 2, includes two paths for current flow. When switch Q1 is turned on, forward current flows through the series LEDs 6 and the forward steering diode 26 in the positive direction to generate light output. When switch Q2 is turned on, reverse current flows through the resistor 28 and the reverse steering diode 30 in the negative direction. In this application, the LEDs 6 are preferably not reverse-biased, since that might violate the LED specifications, and all reverse current flows through the parallel reverse circuit 24. Here, the reverse voltage, at terminal 18 with respect to terminal 20, does not exceed the blocking voltage of steering diode 26.

When switch Q1 is turned on, the light output is generated in response to the positive voltage of the LED drive signal on drive signal conductor 8. Current and voltage readings are taken by the LED drive circuit 2 and are compared to suitable predetermined ranges (e.g., as discussed, below, in connection with Table 1) to verify that the drive signal is working correctly. If the readings fall outside of the predetermined ranges, then that is an indication that the drive signal may not be working properly and that the LED circuit 4 and/or the LED drive circuit 2 may need to be replaced or serviced.

When switch Q1 is turned off, there is no light output arising from the LED drive signal. Given that the drive signal drives a number of "naked" LEDs 6, there is the risk that noise could result in the drive signal generating light output when it should not. The LEDs 6 have a relatively low power factor and a charge induced on the drive signal could cause these LEDs to light (e.g., the LEDs may be employed in a relatively very noisy electrical environment). For example, a light signal turning on when it is supposed to be off may be very dangerous in certain railroad applications. Hence, the LED drive circuit 2 applies a suitable negative potential to the drive signal. By turning on switch Q2, a negative voltage is applied to the drive signal, causing current to flow though the resistor 28 in the reverse direction through the reverse steering diode 30. This increases the amount of electrical noise necessary to cause the LEDs 6 to light, since the negative potential will have to be overcome to switch the direction of current flow and possibly light the LEDs 6.

When switch Q2 is turned on, the current and voltage to the drive signal are monitored, similar to when switch Q1 is turned on. Given that there is a fixed predetermined resistance in the resistor 28 of the reverse circuit 24, the readings will fall into the predetermined range when the drive signal is working correctly. If any readings fall outside of this range, then that is an indication that there is a problem with the drive signal and that the LED drive circuit 2 and/or LED circuit 4 may need to be replaced or serviced.

The negative potential, thus, has two purposes. First, it provides an OFF signal with additional immunity to electrical noise that, otherwise, may cause the LED circuit 4 to improperly light. Second, it allows the LED drive circuit 2 to check the integrity of the OFF state of the drive signal and determine if the LED drive circuit 2 and/or the LED circuit 4 needs to be replaced without having to turn the corresponding LEDs 6 ON.

Example 2

Figure 2:
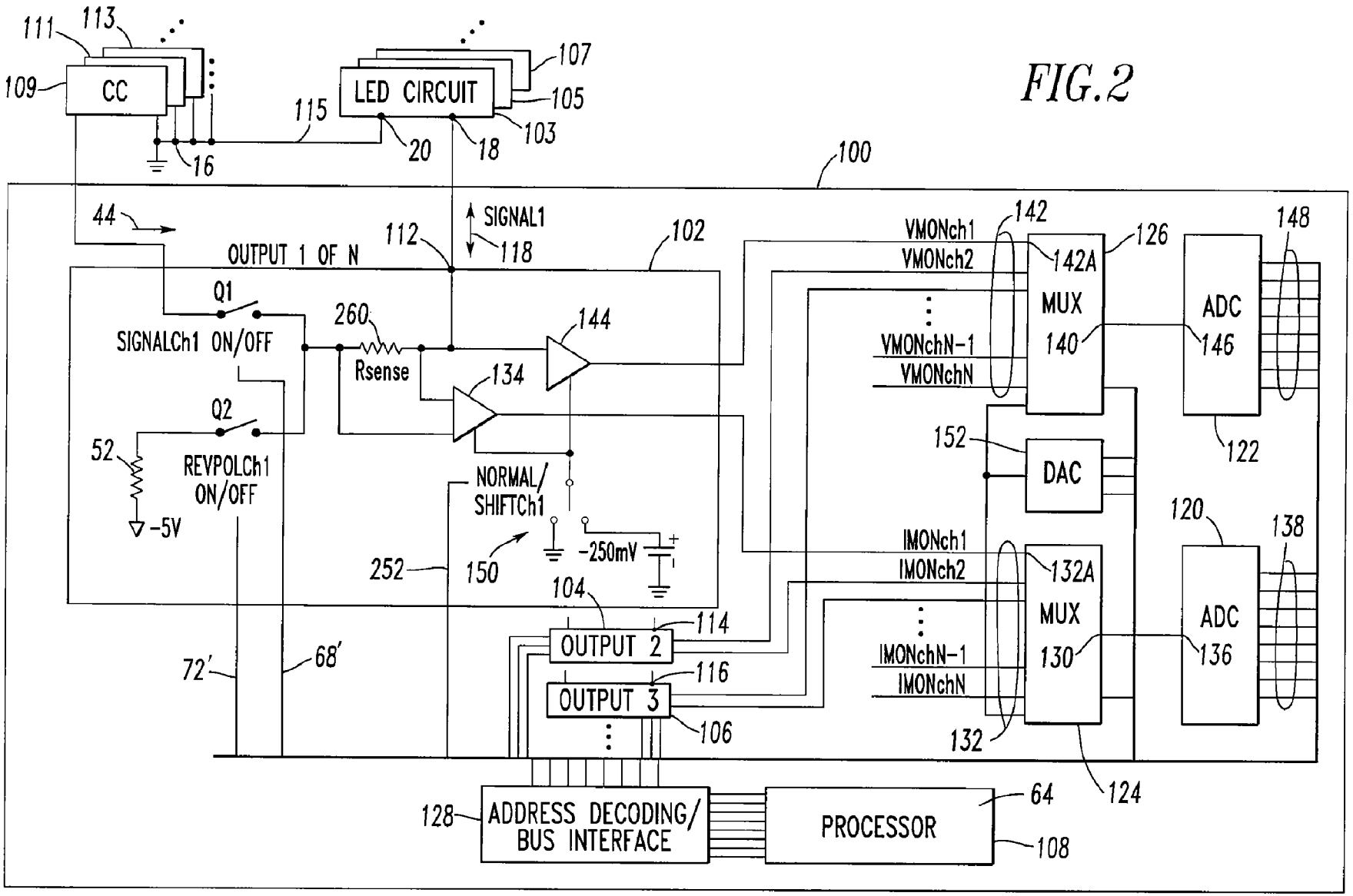
FIG. 2 is a block diagram in schematic form of an LED drive circuit in accordance with another embodiment of the invention.

Referring to FIG. 2, in order to avoid the use of hardware check pulses, an LED drive circuit 100 independently shifts the current and voltage readings for each of plural drive channels 102,104,106 by a predetermined amount, which is read by a processor 108. In turn, the processor 108 verifies that it is reading the expected channel. Each of the drive channels 102,104,106 is associated with a corresponding LED circuit 103,105,107 and a corresponding constant current regulator 109,111,113, respectively. The LED circuits 103,105,107 may be similar to the LED circuit 4 of FIG. 1, and the constant current regulators 109,111,113 may be similar to the constant current regulator 12 of FIG. 1. For each of the LED circuits 103,105,107, a single common return conductor 115 is employed for all of the outputs, such as 112. Alternatively, individual return conductors (not shown) may be employed for each of the LED circuits.

The LED drive circuit 100 includes a plurality of outputs 112,114,116 for driving a number of LED drive signals, such as 118 (SIGNAL 1). The LED drive circuit 100 monitors the current and voltage for each individual output with a common data acquisition circuit, which includes analog-to-digital converters (ADCs) 120,122 and analog multiplexers 124,126. The ADCs 120,122 correspond, for example, to the analog inputs 38,40, respectively, of FIG. 1. For each of the drive channels 102,104,106 (although three drive channels are shown, two, four or more may be employed), the processor 108, through a suitable address decoding/bus interface 128, controls a first signal (SIGNALCh1 as shown with the first drive channel 102) 68' and a second signal (REV/POLCh1 as shown with the first drive channel 102) 72', which are similar to the respective signals 68 and 72 of FIG. 1.

In this example, a first analog input includes the first analog multiplexer 124 having an output 130 and a plurality of inputs 132 inputting a current signal from the output of a corresponding one of the LED drive channels 102,104,106. For example, the current associated with the output 112 of the LED drive channel 102 is buffered by amplifier 134 and input as signal IMONch1 by multiplexer input 132A. In turn, the ADC 120 includes an input 136 from the output 130 of the first analog multiplexer 124 and an output 138 to the microprocessor address decoding/bus interface 128. A second analog input includes the second analog multiplexer 126 having an output 140 and a plurality of inputs 142 inputting a voltage signal from the output of a corresponding one of the LED drive channels 102,104,106. For example, the voltage associated with the output 112 of the LED drive channel 102 is buffered by amplifier 144 and input as signal VMONch1 by multiplexer input 142A. In turn, the ADC 122 includes an input 146 from the output 140 of the second analog multiplexer 126 and an output 148 to the microprocessor address decoding/bus interface 128. In a manner well known to those of ordinary skill in the art, the processor 108 is structured to control the first and second multiplexers 124,126 and to read the outputs 138,148 of the first and second ADCs 120,122.

In accordance with an important aspect of this example, the LED drive channel 102 further includes an offset circuit 150 structured to add a predetermined offset voltage to a corresponding pair of the inputs (e.g., 132A,142A) of the first and second analog multiplexers 124,126. The processor 108 is further structured to select the corresponding pairs of the inputs (e.g., 132A,142A) of the first and second analog multiplexers 124,126 through the microprocessor address decoding/bus interface 128. In this manner, the processor 108 may advantageously select and read all of the converted voltage and current signals from the first and second ADCs 120,122 and to add the predetermined offset voltage to both of the voltage and current signals for a corresponding selected one of the LED circuits, such as 103. Hence, the processor 108 preferably individually shifts the offset of the current reading and the voltage reading for each of the plural LED drive channels 102,104,106 by a predetermined value, in order to verify that the processor 108 is reading the current and the voltage for the expected LED channel and to verify the current and voltage amplifiers 134,144.

The voltage and current readings for a properly operating drive signal are very similar for all of the LED drive channels 102,104,106. Since a common circuit is used to process the data for each of the LED drive circuit outputs 112,114,116, the processor 108 verifies that the data being read corresponds to the expected output (e.g., that one of the analog multiplexers 124,126 has not failed and processes, for example, output #3 (not shown) rather than the intended output, such as output #5 (not shown)). Since a selected one of the LED drive channels 102,104,106 offsets the current and voltage readings for an individual output by a predetermined value (e.g., a suitable predetermined DC voltage), this offset voltage is detected and permits the processor 108 to verify that it is processing the intended output. The processor 108 employs this predetermined DC voltage offset to verify that all of the amplifiers 134,144 of the LED drive channels 102,104,106 are working properly. The offset is always the same fixed predetermined value, which is detected through the ADC readings. If the amount of the offset is not correct, then this identifies a possible problem with the corresponding LED drive channel. By individually offsetting the output readings, the processor 108 verifies that the selected LED drive channel is working properly without having to turn the drive signals ON and OFF.

As is conventional, the processor 108 may verify the functionality of the ADCs 120,122 through the use of a digital-to-analog converter (DAC) 152 with a separate voltage reference. For example, if the count of the various LED drive channels 102,104,106 is N (e.g., N=2 or more; N=12), then the DAC 152 is input by the (N+1)th channel of the analog multiplexers 124,126. The processor 108, thus, reads/controls the ADCs 120,122, controls the analog multiplexers 124,126, controls the DAC 152, and controls the N sets of Q1/Q2 switches that form the N LED drive channels, as best shown with channel 102. Similar to the above discussion in connection with FIG. 1, the processor 108 is structured to activate a corresponding one of the first outputs, such as 68', and to deactivate a corresponding one of the second outputs, such as 72', in order to illuminate the corresponding one of the LED circuits, such as 103. Similarly, the processor 108 is structured to activate a corresponding one of the second outputs, such as 72', and to deactivate a corresponding one of the first outputs, such as 68', in order to darken the corresponding one of the LED circuits, such as 103.

The processor 108 determines if each of the N example LED drive signals is drawing the correct current for the ON or OFF states. If so, then for the ON state, the processor 108 may make the reasonable assumption that LEDs (not shown) of the corresponding one of the LED circuits 103,105,107 are outputting light. However, it cannot guarantee, for example, that the correct amount of light is being emitted by the LEDs or that the output light signal is pointing in the right direction. Thus, the combined LED drive circuit 100 and LED circuit, such as 103, are fail-safe, but the output light signal, itself, is not vital.

Example 3

Figure 3:
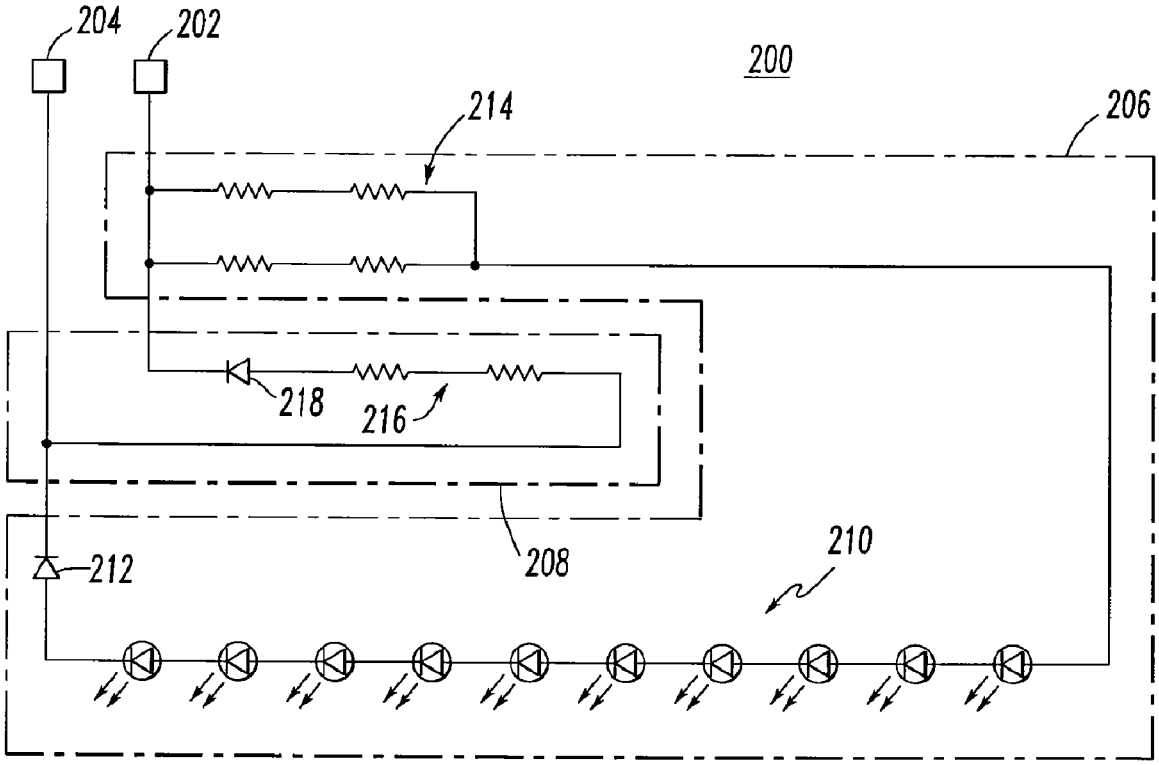
FIG. 3 is a block diagram in schematic form of an LED circuit in accordance with another embodiment of the invention.

FIG. 3 shows another LED circuit 200 including a first terminal 202, a second terminal 204, a forward circuit 206 and a reverse circuit 208. The example forward circuit 206 includes a number of LEDs 210 (e.g., 10 LEDs, as shown; any suitable count of LEDs (e.g., one or more) may be employed (with a suitable voltage output by the corresponding LED drive circuit)) electrically connected in series, and a forward steering diode 212 electrically connected in series with the LEDs 210. The series combination of the forward steering diode 212 and the LEDs 210 is electrically connected between the first and second terminals 202,204 and is structured to conduct current in a first direction from the first terminal 202 to the second terminal 204 in order to illuminate the LEDs 210. Although not required, a suitable resistance 214 may be electrically connected in series with that series combination of the forward steering diode 212 and the LEDs 210, although any suitable resistance, including about 0 ohms, may be employed. The reverse circuit 208 includes a resistor 216 (e.g., two series resistors are shown; any suitable combination of a number of resistive elements) and a reverse steering diode 218 electrically connected in series with the resistor 216. The series combination of the reverse steering diode 218 and the resistor 216 is electrically connected between the first and second terminals 202,204 and is structured to conduct current from the second terminal 204 to the first terminal 202, in order that the LEDs 210 are not illuminated.

The first terminal 202 is the positive terminal (+) of the drive signal and the second terminal 204 is the negative terminal (−) and is connected to ground (e.g., as shown with the common terminal 16 of FIG. 1). First positive terminal 202 goes to the corresponding LED drive circuit and either has current flowing into it (when the drive signal is ON) or current flowing out of it (when the negative voltage is applied to the drive signal conductor, such as 8 of FIG. 1).

Example 4

The forward steering diode 212 is preferably a schottky diode having a blocking voltage. The series combination of the reverse steering diode 218 and the resistor 216 is structured to receive a reverse voltage between the first and second terminals 202,204, with the magnitude of the blocking voltage being substantially greater than the magnitude of the reverse voltage. As a non-limiting example, the magnitude of the example blocking voltage is about 100 volts, and the magnitude of the reverse voltage is about 2 volts. For example, the steering diodes 212,218 may be 100V, MBRS1100, schottky barrier rectifier diodes marketed by ON Semiconductor, of Phoenix, Ariz. As was discussed above, when the LEDs 210 are not driven, the corresponding LED drive circuit, such as 100 (FIG. 2) or 2 (FIG. 1), applies a negative potential to the drive signal conductor 8 (FIG. 1) to counteract the induction of noise that may light the LEDs 210.

Example 5

In this example, the resistance 214 of the forward circuit 206 is not necessarily zero ohms and is, preferably, selected based upon the type or color (e.g., without limitation, red; amber; cyan; white) of the LEDs 210. The LEDs 210 may include, for example, a common color and a common forward voltage, with the common forward voltage being operatively associated with the common color and the current in the forward direction from terminal 202 to terminal 204, which forward current illuminates the LEDs 210. For example, suitable selection of the series resistance 214 may make different color LEDs function the same electrically (at terminals 202, 204), since those different color LEDs have different forward voltages.

Example 6

Figure 4:
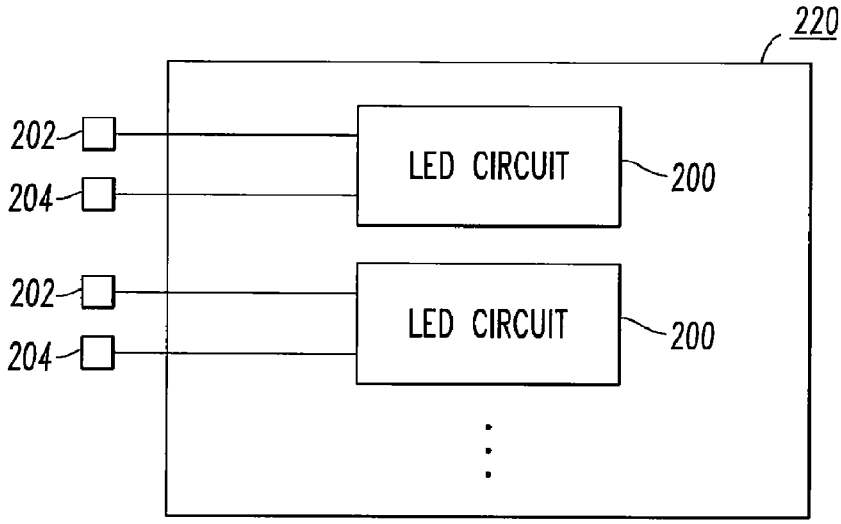
FIG. 4 is a block diagram of a signal apparatus in accordance with another embodiment of the invention.

FIG. 4 shows a signal apparatus 220 including a number of the LED circuits 200 of FIG. 3. For example, one of the LED circuits may have one color (e.g., red) and another LED circuit may have a different color (e.g., amber).

Example 7

Figure 5:
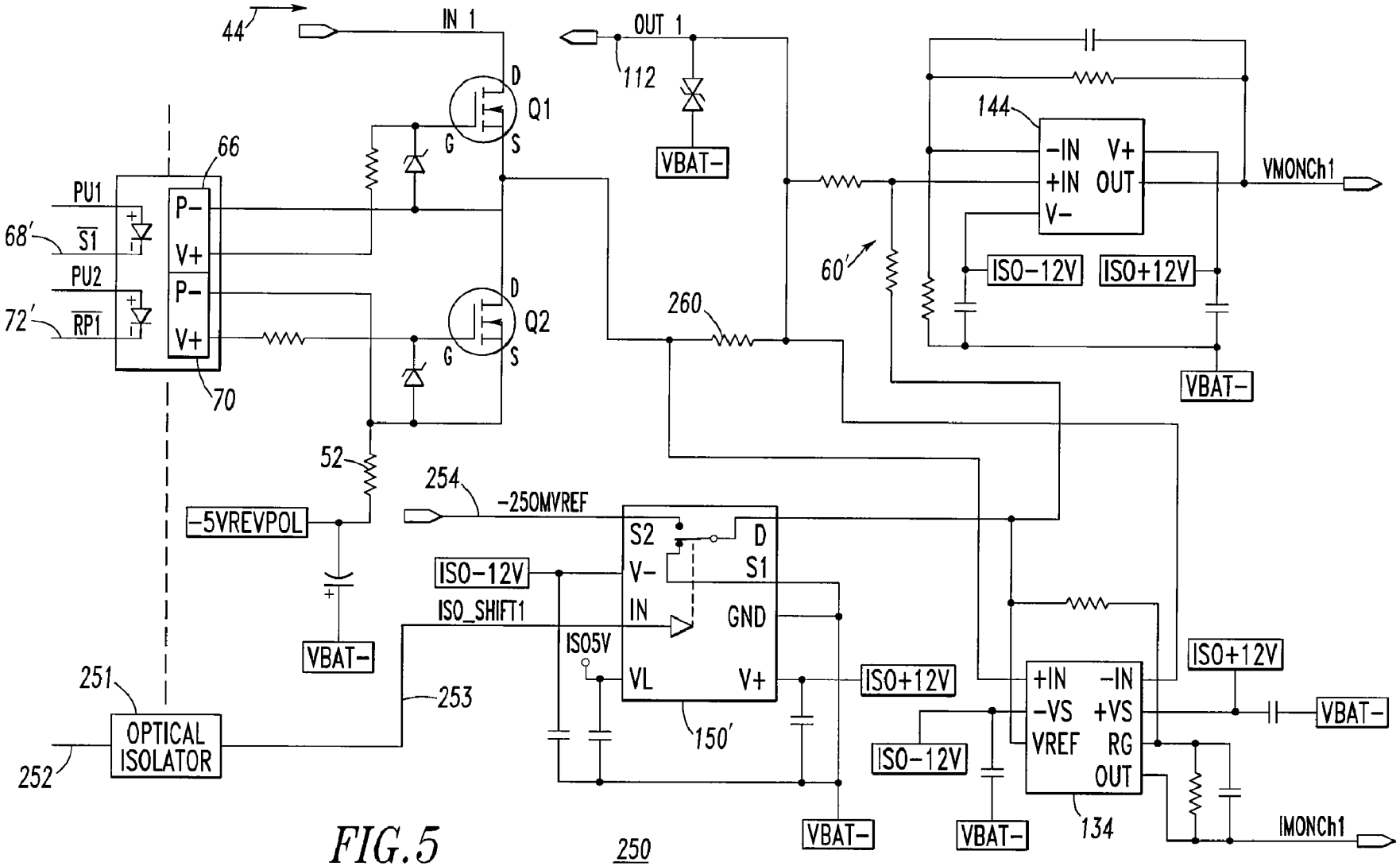
FIG. 5 is a block diagram in schematic form of an LED drive circuit in accordance with another embodiment of the invention.

Referring to FIG. 5, an LED drive circuit 250 is somewhat similar to the LED drive circuit 100 of FIG. 2 as applied to the drive channel 102 thereof. An optical isolator 251 receives a control signal from the address decoding/bus interface 128 of FIG. 2 and outputs an ISO_SHFT1 signal 253 to an analog switch 150'. Through the analog switch 150', the LED drive circuit 250 selectively sums a predetermined DC offset (e.g., −250 mV) 254 into the IMON amplifier 134 and the VMON amplifier 144 for the corresponding individual drive channel (e.g., drive channel 102 of FIG. 2). The gains for all the drive channels 102,104,106 of FIG. 2 are the same. By summing in the predetermined DC offset to an individual drive channel, the processor 108 of FIG. 2 determines that it is reading the correct drive channel IMON and VMON values because those readings will be different from the other channel values by the predetermined DC offset (e.g., 250 mV lower than the others). The IMON and VMON amplifiers 134,144 are checked since there will be the predetermined DC offset change at the ADC inputs 136,146 (FIG. 2), unless something is wrong.

For example, normally, the ISO_SHFT1 signal 253 is false and the analog switch 150' is in the default S1 position, as shown. There, the output D of the analog switch 150' is normally electrically connected to the ground VBAT−. The grounded output D is electrically connected to the VREF input of the IMON amplifier 134 and to the VMON resistor divider 60'. Otherwise, when the corresponding drive channel (e.g., drive channel 102 of FIG. 2) is selected, the ISO_SHFT1 signal 253 is true and the analog switch 150' is in the S2 position. There, the output D of the analog switch 150' is electrically connected to the predetermined DC offset (e.g., −250 mV) 254, which is applied to both the VREF input of the IMON amplifier 134 and to the VMON resistor divider 60'.

Example 8

For example, if the example LED drive circuit 100 of FIG. 2 has 12 outputs, and if all 12 outputs are turned on, then all output drive signals are the same and each output normally has similar voltage and current readings (e.g., without limitation, about 1 VDC for VMON and about 500 mV for IMON). In order to differentiate each drive channel, such as 102,104,106, the predetermined DC offset (e.g., −250 mV) is individually summed into the readings for the selected drive channel. Hence, if this offset is applied to only the first output #1, then its new reading, in this example, will be about 750 mV for VMON and about 250 mV for IMON. Next, the processor 108 verifies that these values are different than the corresponding values for the other 11 example drive channels. This, also, verifies that the analog multiplexers 124,126 (FIG. 2) are operating properly (e.g., by individually shifting each drive channel one at a time). Also, the processor 108 compares a reading before and after a shift versus an expected value. This verifies that all of the amplifiers 134,144 for a particular drive channel are working properly (e.g., since the offset is applied at only the first drive channel in this example).

Example 9

The example voltage and current amplifiers 134,144 (as best shown in FIG. 5) are slightly different due to the relatively high common mode voltages present and the different scaling; however, the overall function is the same for both amplifiers.

Example 10

As was discussed above in connection with FIG. 1, the processor 42 may include the routine 64 to determine whether an LED circuit, such as 4, is properly or improperly driven under various different conditions. It will be appreciated that this routine 64 may also be applicable to the processor 108 of FIG. 2.

Table 1, below, shows expected hardware states for a specific non-limiting example configuration as employed by the routine 64. The various voltages, currents, resistances and count of LEDs are non-limiting examples. This example employs a series string of ten green Luxeon® K2 LEDs, with a total forward drop of about 34.95 V (e.g., about 3.42 for each of the ten LEDs 210 of FIG. 3 plus about 0.75 V for the forward voltage drop of the forward steering diode 212), and with about 0 ohms of resistive padding of the resistance 214. The LEDs 210 are powered by a constant current source (e.g., constant current regulator 12 of FIG. 1; constant current regulator 109 of FIG. 2), which outputs about +350 mA over a voltage range of about 0 to about 50 V. The reverse polarity is about a −5 V constant voltage source (e.g., −5V of FIG. 1; −5REVPOL of FIG. 5). The parallel load resistance 216 of FIG. 3 is about 50 ohms, with an additional about 50 ohms in resistor 260 (FIGS. 1, 2 and 5) for a total of about 100 ohms. The forward voltage drop of the reverse steering diode 218 of FIG. 3 is about 0.75 V.

TABLE 1

| SIGNAL | REVPOL | LOAD CURRENT | LOAD VOLTAGE | STATUS |
|---|---|---|---|---|
| OFF | OFF | ~0 A | ~0 V | OK; signal OFF (no addition protection against induction; no indication of signal condition) |
| OFF | OFF | ~350 mA | >0 V | BOARD FAILURE; Q1 stuck closed |
| OFF | OFF | ~−43 mA | ~−2.9 V | BOARD FAILURE; Q2 stuck closed |
| OFF | OFF | ~0 A | ~13 V | BOARD FAILURE; Q1 and Q2 both stuck closed |
| OFF | ON | ~−43 mA | ~−2.9 V | OK; signal OFF and intact; additional protection against induction |
| OFF | ON | ~0 A | ~0 V | BOARD FAILURE; Q2 stuck open |
| OFF | ON | ~0 A | ~13 V | BOARD FAILURE; Q1 stuck closed |
| OFF | ON | ~0 A | ~−5 V | SIGNAL FAULT; open load |
| OFF | ON | ~−100 mA | ~0 V | SIGNAL FAULT; shorted load |
| ON | OFF | ~350 mA | >17.85 V | OK; signal ON and |

TABLE 1-continued

| SIGNAL | REVPOL | LOAD CURRENT | LOAD VOLTAGE | STATUS |
|---|---|---|---|---|
| | | | | intact; producing satisfactory light output (5 or more LEDs are not shorted) |
| ON | OFF | ~0 A | ~0 V | BOARD FAILURE; Q1 stuck open |
| ON | OFF | ~0 A | ~13 V | BOARD FAILURE; Q2 stuck closed |
| ON | OFF | ~0 A | >34.95 V | SIGNAL FAULT; open load |
| ON | OFF | ~350 mA | <17.85 V | SIGNAL FAULT; shorted load or unsatisfactory light output (more than 5 LEDs are shorted) |

In this example, a fault (e.g., SIGNAL FAULT) is considered to be a failure of a system component that does not prevent a separate controller (not shown) (e.g., a MICROLOK II system; an Interlocking Control System (ICS)), which cooperates with the processor 42 (FIG. 1) or the processor 108 (FIG. 2), from continuing to operate. One example of an ICS is the Microlok® railroad interlocking control system for railroad switching and signaling, as described in U.S. Pat. No. 5,301,906, which is hereby incorporated herein by reference. Although Microlok® units are disclosed, the invention is applicable to other signal equipment, other ICS signal equipment, railway control circuitry, railway signaling, and railway logic devices, such as, for example, a Microlok® II Wayside Control System marketed by Union Switch & Signal, Inc. of Pittsburgh, Pa.

The failure of a signal is an expected fault and is detected and managed by the controller (not shown). One example is a green signal burning out. One possible system response to that failure is to turn off the faulty signal and to turn on a yellow signal of that same signal head. Thus, when an output signal fault occurs, the controller continues normal operation.

A system failure (e.g., BOARD FAILURE) is the failure of a system component that prevents the system from continuing to perform its vital operation. As one example, if a component on the LED drive circuit (e.g., 4 of FIG. 1; 100 of FIG. 2) shorts or burns open, then the ability to determine the output state may be compromised. When a system failure occurs, the controller (not shown) turns off all vital outputs (e.g., 321 of FIG. 6) and resets its operation. If the failure continues to be detected by the controller, then the system enters a reduced maintenance mode where all the vital outputs 321 are disabled.

Table 1, above, shows three OK states, four different faults and seven different failures. The failure states (e.g., stuck open; stuck shorted) of the two switches Q1 and Q2 are covered, and the current and voltage measurement circuitry is utilized during both the ON and OFF states. The first state of Table 1 shows an OK state, albeit one where the signal is OFF, there is no addition protection against induction, and there is no indication of the signal condition. The fifth state of Table 1 shows the second OK state where the signal is OFF and intact, and additional protection against induction is provided. The tenth state of Table 1 shows the third OK state where the signal is ON and intact, and produces satisfactory light output (e.g., five or more series LEDs 210 of FIG. 3 are not shorted).

As a few examples of the functions of the routine 64, the processor (e.g., 42 of FIG. 1; 108 of FIG. 2) may determine whether: (1) an electrical connection between the LED circuit 4 and the third output 46 is open or shorted, or whether a number of the LEDs 210 of FIG. 3 are shorted; (2) an electrical connection between the LED circuit 4 and the third output 46 is open or shorted; (3) the first switch 50 (Q1) has failed open or the second switch 56 (Q2) has failed closed; (4) the first switch 50 (Q1) has failed closed or the second switch 56 (Q2) has failed open; (5) the first switch 50 (Q1) has failed closed, the second switch 56 (Q2) has failed closed, both of the first and second switches 50,56 have failed closed, or the voltage of the third output 46 is about zero, when both the first switch 50 (Q1) and the second switch 56 (Q2) are intended to be deactivated; (6) the current in the reverse direction from the third output 46 and the negative voltage thereof are properly applied to the LED circuit 4 (i.e., this shows that the desired negative potential is properly applied when the LED circuit 4 is properly driven off with noise protection); and/or (7) the current in the positive direction from the third output 46 and the positive voltage thereof are properly applied to the LED circuit 4.

Example 11

Figure 6:
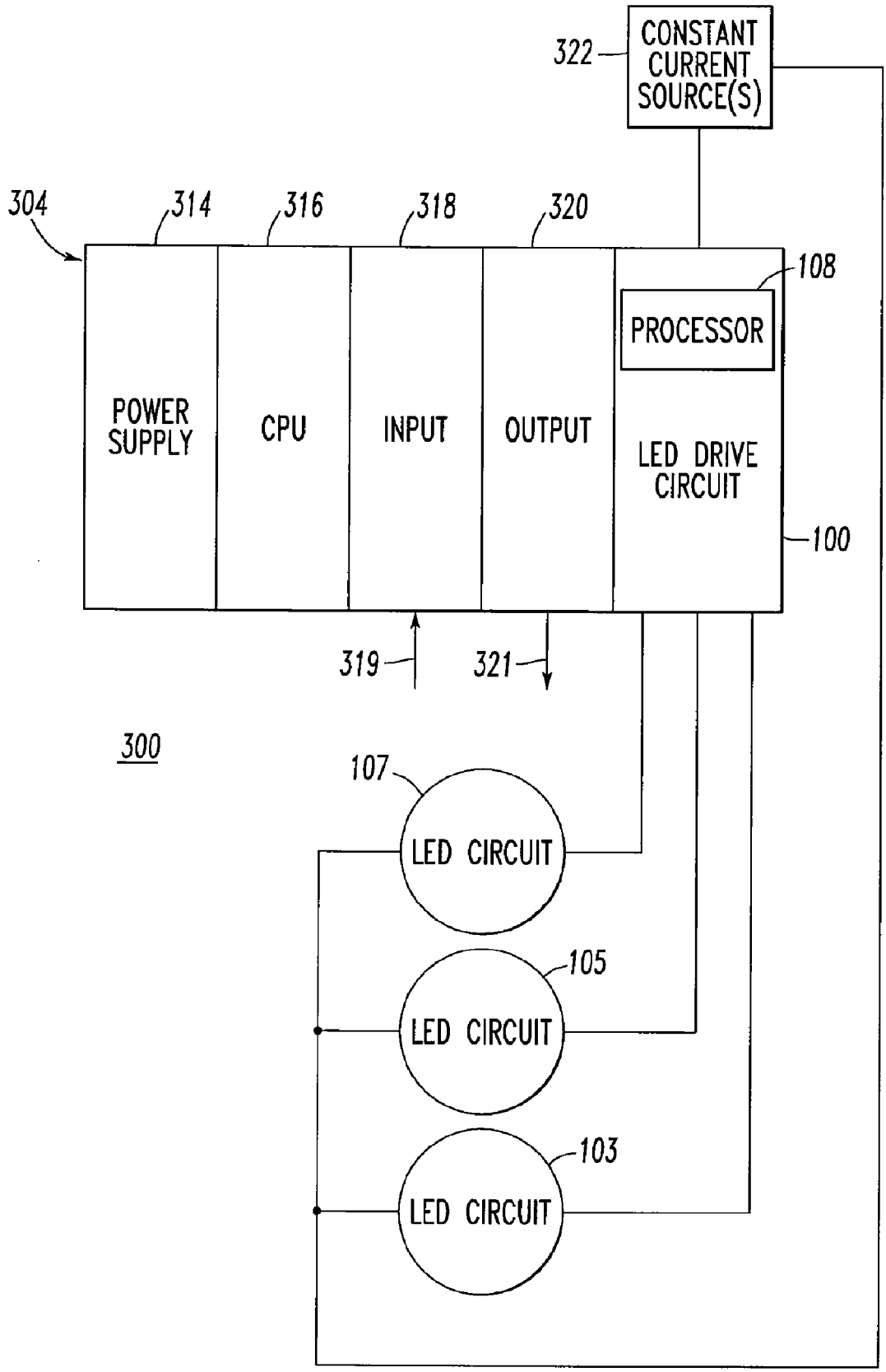
FIG. 6 is a block diagram of an interlocking control system including a processor and an LED drive circuit in accordance with another embodiment of the invention.

Referring to FIG. 6, an apparatus, such as an Interlocking Control System (ICS) 300, includes a processor unit 304 having a power supply 314, a central processing unit (CPU) 316, one or more vital input boards 318 (only one shown) inputting a plurality of vital inputs 319, one or more vital output boards 320 (only one shown) outputting a plurality of vital outputs 321, the LED drive circuit 100 of FIG. 2, and a plurality of externally mounted constant current regulators 322. The CPU 316 is programmed to control the illuminated or dark state of each of the example LED circuits 103, 105, 107. The CPU 316 may directly control the state of the LED circuits 103, 105, 107, or, alternatively, may control the state of the LED circuits 103, 105, 107 through an optional processor 108 (as shown) on the LED drive circuit 100.

The example LED drive circuits 2,100,250 allow for a true "naked" LED array (e.g., with only a load resistance, forward and reverse steering diodes and optional lightning protection (not shown) between the LED drive circuit and the LED circuit, such as 200 of FIG. 3) with protection from light output due to induction on the drive signal conductor 8 (FIG. 1). These example LED drive circuits need control only the positive terminal, such as 202 of the LED circuit 200 of FIG.

3, with the drive signals having a common return line, such as 115 of FIG. 2. Alternatively, individual return lines (not shown) may be employed for each of the LED circuits. These LED drive circuits employ only two switches Q1,Q2 per drive signal output, of which, switch Q2 may be relatively low power. As a non-limiting example, the OFF outputs draw a nominal power of about 0.25 W each at 5 VDC and −50 mA.

The example LED drive circuits 2,100,250 further allow for continuity checking during the OFF-state, as was shown in connection with Table 1, above.

The example plural-channel LED drive circuits 100,250 permit the processor 108 to verify that it is reading the currents and voltages for the selected drive channel.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A signal apparatus comprising:

a number of light emitting diode circuits, each of said light emitting diode circuits comprising:

a first terminal;

a second terminal;

a forward circuit comprising:

a number of light emitting diodes electrically connected in series, and a forward steering diode electrically connected in series with said light emitting diodes, wherein the series combination of said forward steering diode and said light emitting diodes is electrically connected between said first and second terminals, and wherein said series combination is structured to conduct current in a first direction with respect to said first and second terminals in order to illuminate said light emitting diodes; and a reverse circuit comprising:

a resistor, and a reverse steering diode electrically connected in series with said resistor, wherein the series combination of said reverse steering diode and said resistor is electrically connected between said first and second terminals, wherein said series combination of said reverse steering diode and said resistor is structured to conduct current in a second direction with respect to said first and second terminals in order that said light emitting diodes are not illuminated, and wherein said second direction is opposite said first direction.

2. A light emitting diode circuit comprising:

a first terminal;

a second terminal;

a forward circuit comprising:

a number of light emitting diodes electrically connected in series, and a forward steering diode electrically connected in series with said light emitting diodes, wherein the series combination of said forward steering diode and said light emitting diodes is electrically connected between said first and second terminals, and wherein said series combination is structured to conduct current in a first direction with respect to said first and second terminals in order to illuminate said light emitting diodes; and a reverse circuit comprising:

a resistor, and a reverse steering diode electrically connected in series with said resistor, wherein the series combination of said reverse steering diode and said resistor is electrically connected between said first and second terminals, wherein said series combination of said reverse steering diode and said resistor is structured to conduct current in a second direction with respect to said first and second terminals in order that said light emitting diodes are not illuminated, and wherein said second direction is opposite said first direction.

3. The light emitting diode circuit of claim 2 wherein said forward steering diode is a schottky diode having a blocking voltage; wherein said series combination of said reverse steering diode and said resistor is structured to receive a reverse voltage between said first and second terminals; and wherein the magnitude of said blocking voltage is substantially greater than the magnitude of said reverse voltage.

4. The light emitting diode circuit of claim 3 wherein the magnitude of said blocking voltage is about 100 volts; and wherein the magnitude of said reverse voltage is about 2 volts.

5. The light emitting diode circuit of claim 2 wherein said forward circuit further comprises a resistor, said resistor being electrically connected in series with the series combination of said forward steering diode and said light emitting diodes.

6. The light emitting diode circuit of claim 5 wherein the resistor of said forward circuit includes a resistance; wherein said light emitting diodes include a common color and a common forward voltage, said common forward voltage being operatively associated with said common color and said current in a first direction which illuminates said light emitting diodes; and wherein the resistance of the resistor of said forward circuit is selected as a function of said common forward voltage and said common color.

7. The light emitting diode circuit of claim 6 wherein the common color of said light emitting diodes is selected from the group consisting of red, amber, cyan and white.

8. A light emitting diode drive circuit for driving a number of light emitting diode circuits, each of said light emitting diode circuits including a forward circuit having a number of light emitting diodes electrically connected in series, said light emitting diodes being structured to conduct current in a forward direction and to be responsively illuminated, each of said light emitting diode circuits also including a reverse circuit electrically connected in parallel with said forward circuit, said reverse circuit being structured to conduct current in a reverse direction which is opposite said forward direction, said light emitting diode drive circuit comprising:

a processor circuit comprising:

a number of first outputs, a number of second outputs, a first analog input, a second analog input, and a processor outputting said first and second outputs and inputting said first and second analog inputs; and for each of said number of light emitting diode circuits:

a third input structured to receive a constant current, a third output including a voltage, said third output being structured to drive a corresponding one of said light emitting diode circuits, a first switch responsive to a corresponding one of the first outputs of said processor circuit, said first switch being closed to conduct said constant current in said forward direction to said third output, in order that said conducted constant current in said forward direction to said third output illuminates the light emitting diodes of the corresponding one of said light emitting diode circuits, a circuit structured to sink said current in said reverse direction, a second switch responsive to a corresponding one of the second outputs of said processor circuit, said second switch being closed to conduct said current in said reverse direction from said third output to said circuit structured to sink said current in said reverse direction, in order that said conducted current in said reverse direction from said third output flows in the reverse direction though the reverse circuit of the corresponding one of said light emitting diode circuits, a current sensor structured to sense said constant current in said forward direction to said third output or said current in said reverse direction from said third output and to output a sensed current signal to the first analog input of said processor circuit, and a voltage sensor structured to sense the voltage of said third output and to output a sensed voltage signal to the second analog input of said processor circuit.

9. The light emitting diode drive circuit of claim 8 wherein said number of first outputs is a plurality of first outputs; wherein said number of second outputs is a plurality of second outputs; wherein said number of light emitting diode circuits is a plurality of light emitting diode circuits; wherein said first analog input includes a first analog multiplexer having an output and a plurality of inputs inputting a current signal from the third output of a corresponding one of said light emitting diode drive circuits; wherein said first analog input further includes a first analog to digital converter including an input from the output of said first analog multiplexer and an output for said processor; wherein said second analog input includes a second analog multiplexer having an output and a plurality of inputs inputting a voltage signal from the third output of the corresponding one of said light emitting diode drive circuits; wherein said second analog input further includes a second analog to digital converter including an input from the output of said second analog multiplexer and an output for said processor; and wherein said processor is structured to control said first and second multiplexers and to read the outputs of said first and second analog to digital converters.

10. The light emitting diode drive circuit of claim 9 wherein said processor circuit further includes an offset circuit structured to add a predetermined offset voltage to a corresponding pair of the inputs of said first and second analog multiplexers; and wherein said processor is further structured to select the corresponding pair of the inputs of said first and second analog multiplexers for said offset circuit.

11. The light emitting diode drive circuit of claim 10 wherein said processor is further structured to select and read all of the converted voltage and current signals from said first and second analog to digital converters and to add the predetermined offset voltage to both of said voltage and current signals for a corresponding selected one of said light emitting diode circuits.

12. The light emitting diode drive circuit of claim 9 wherein said processor is structured to activate a corresponding one of said first outputs and to deactivate a corresponding one of said second outputs in order to illuminate the corresponding one of said light emitting diode circuits.

13. The light emitting diode drive circuit of claim 9 wherein said processor is structured to activate a corresponding one of said second outputs and to deactivate a corresponding one of said first outputs in order to darken the corresponding one of said light emitting diode circuits; wherein each of said light emitting diode circuits includes a forward steering diode electrically connected in series with the light emitting diodes of a corresponding one of said each of said light emitting diode circuits, said forward steering diode having a blocking voltage; and wherein the voltage of the third output of the corresponding one of said light emitting diode drive circuits is negative and has a magnitude which is less than said blocking voltage.

14. The light emitting diode drive circuit of claim 13 wherein said processor includes a routine structured to determine that said current in said reverse direction from said third output and the negative voltage of said third output are properly applied to the corresponding one of said light emitting diode circuits.

15. The light emitting diode drive circuit of claim 12 wherein the voltage of the third output of the corresponding one of said light emitting diode drive circuits is positive; and wherein said processor includes a routine structured to determine that said current in said positive direction from said third output and the positive voltage of said third output are properly applied to the corresponding one of said light emitting diode circuits.

16. The light emitting diode drive circuit of claim 9 wherein for each of said number of light emitting diode circuits, said third input structured to receive a constant current includes a single common conductor for all of said third outputs.

17. A display system comprising:

a constant current regulator including an output and a common terminal;

a light emitting diode circuit comprising:

a first terminal;

a second terminal electrically connected to the common terminal of said constant current regulator;

a forward circuit comprising:

a number of light emitting diodes electrically connected in series, and a forward steering diode electrically connected in series with said light emitting diodes, wherein the series combination of said forward steering diode and said light emitting diodes is electrically connected between said first and second terminals, and wherein said series combination is structured to conduct current in a first direction with respect to said first and second terminals in order to illuminate said light emitting diodes; and a reverse circuit comprising:

a resistor, and a reverse steering diode electrically connected in series with said resistor, wherein the series combination of said reverse steering diode and said resistor is electrically connected between said first and second terminals, wherein said series combination of said reverse steering diode and said resistor is structured to conduct current in a second direction with respect to said first and second terminals in order that said light emitting diodes are not illuminated, and wherein said second direction is opposite said first direction; and a light emitting diode drive circuit comprising:

a processor circuit comprising:

a first output, a second output, a first analog input, a second analog input, and a processor outputting said first and second outputs and inputting said first and second analog inputs;

a third input structured to receive a constant current from the output of said constant current regulator, a third output including a voltage, said third output driving the first terminal of said light emitting diode circuit, a first switch responsive to the first output of said processor circuit, said first switch being closed to conduct said constant current in said forward direction to said third output, in order that said conducted constant current in said forward direction to said third output illuminates the light emitting diodes of said light emitting diode circuit, a sink circuit structured to sink said current in said reverse direction, a second switch responsive to the second output of said processor circuit, said second switch being closed to conduct said current in said reverse direction from said third output to said sink circuit structured to sink said current in said reverse direction, in order that said conducted current in said reverse direction from said third output flows in the reverse direction though the reverse circuit of said light emitting diode circuit, a current sensor structured to sense said constant current in said forward direction to said third output or said current in said reverse direction from said third output and to output a sensed current signal to the first analog input of said processor circuit, and a voltage sensor structured to sense the voltage of said third output and to output a sensed voltage signal to the second analog input of said processor circuit.

18. The display system of claim 17 wherein said processor is structured to activate said first output and to deactivate said second output in order to illuminate said light emitting diode circuit; and wherein said processor includes a routine structured to determine whether said light emitting diode circuit is properly or improperly driven by said third output.

19. The display system of claim 17 wherein said processor is structured to activate said second output and to deactivate said first output in order to darken said light emitting diode circuit; and wherein said processor includes a routine structured to determine whether said light emitting diode circuit is properly or improperly driven by said third output.

20. The display system of claim 18 wherein the routine of said processor is further structured to determine whether an electrical connection between said light emitting diode circuit and said third output is open or shorted, or whether a number of said light emitting diodes are shorted.

21. The display system of claim 19 wherein the routine of said processor is further structured to determine whether an electrical connection between said light emitting diode circuit and said third output is open or shorted.

22. The display system of claim 18 wherein the routine of said processor is further structured to determine whether said first switch has failed open or whether said second switch has failed closed.

23. The display system of claim 19 wherein the routine of said processor is further structured to determine whether said first switch has failed closed or whether said second switch has failed open.

24. The display system of claim 17 wherein said forward current is about 350 mA.

25. The display system of claim 17 wherein said reverse current is about −50 mA.

26. The display system of claim 17 wherein said processor is structured to deactivate said first output and to deactivate said second output; and wherein said processor includes a routine structured to determine whether said first switch has failed closed, said second switch has failed closed, both of said first and second switches have failed closed, or the voltage of said third output is about zero.

* * * * *

UNITED STATES PATENT AND TRADEMARK OFFICE

CERTIFICATE OF CORRECTION

PATENT NO. : 7,583,244 B2
APPLICATION NO. : 11/382734
DATED : September 1, 2009
INVENTOR(S) : James C. Werner et al.

It is certified that error appears in the above-identified patent and that said Letters Patent is hereby corrected as shown below:

Column 6, line 56, "not reverse-biased" should read -- not reverse-biased --.
Column 11, line 14, "ISO_S-" should read -- ISO_- --.
Column 11, line 15, "HFT1" should read -- SHFT1 --.
Table 1, row 3, column 3, "~–43 mA" should read -- ~ -43 mA --.
Table 1, row 3, column 4, "~–2.9 V" should read -- ~ -2.9 V --.
Table 1, row 5, column 3, "~–43 mA" should read -- ~ -43 mA --.
Table 1, row 5, column 4, "~–2.9 V" should read -- ~ -2.9 V --.
Table 1, row 8, column 4, "~–5 V" should read -- ~ -5 V --.
Table 1, row 9, column 3, "~–100 mA" should read -- ~ -100 mA --.

Signed and Sealed this

Ninth Day of November, 2010

David J. Kappos

David J. Kappos
*Director of the United States Patent and Trademark Office*